US007389784B2

(12) United States Patent
Kuo

(10) Patent No.: US 7,389,784 B2
(45) Date of Patent: Jun. 24, 2008

(54) AUTOMATIC COLLAPSIBLE UMBRELLA

(76) Inventor: Shih-Shin Kuo, 8F, No. 39, Sau nien St., Hsinchu (TW)

( * ) Notice: Subject to any disclaimer, the term of this patent is extended or adjusted under 35 U.S.C. 154(b) by 268 days.

(21) Appl. No.: 11/302,252

(22) Filed: Dec. 14, 2005

(65) Prior Publication Data

US 2007/0131263 A1 Jun. 14, 2007

(51) Int. Cl.
*A45B 25/16* (2006.01)
*A45B 25/14* (2006.01)

(52) U.S. Cl. ..... 135/24; 135/22; 135/25.4

(58) Field of Classification Search ..... 135/20.3, 135/22, 24, 25.1, 25.4
See application file for complete search history.

(56) References Cited

U.S. PATENT DOCUMENTS 4,548,222 A * 10/1985 Day ..... 135/24
5,161,562 A * 11/1992 Wu ..... 135/20.3
5,309,932 A * 5/1994 Chou et al. ..... 135/22
5,441,065 A * 8/1995 Lin et al. ..... 135/24
5,483,985 A * 1/1996 Yu ..... 135/22
5,533,541 A * 7/1996 Cheng et al. ..... 135/22
5,823,215 A * 10/1998 Chou et al. ..... 135/24
6,701,946 B2 * 3/2004 You ..... 135/22
6,810,894 B2 * 11/2004 Chen ..... 135/22
6,817,371 B2 * 11/2004 Lin et al. ..... 135/24
2004/0221884 A1 * 11/2004 Yang ..... 135/24
2005/0257817 A1 * 11/2005 Kuo ..... 135/24
2007/0017561 A1 * 1/2007 Kuo ..... 135/22

* cited by examiner

*Primary Examiner*—David R Dunn
*Assistant Examiner*—Tania Abraham
(74) *Attorney, Agent, or Firm*—Rosenberg, Klein & Lee

(57) ABSTRACT

The invention relates to an automatic collapsible umbrella, which utilizes several springs provided around a shaft or therein accompanying with a runner apparatus and a frame to control the umbrella being opened or closed automatically. The main character of this umbrella is the operating method that is to prolong the umbrella first, and by a first touch to automatically open; then by a second touch to automatically close. The automatic collapsible umbrella therefore obtains utilization and improvement.

5 Claims, 7 Drawing Sheets

AUTOMATIC COLLAPSIBLE UMBRELLA

BACKGROUND OF THE INVENTION

A traditional umbrella is manually operated and is inconvenient for use. A known improved umbrella can be opened automatically by only a single push on a button of a handle. But this umbrella must be manually closed and is still inconvenient. There is a better improvement; U.S. Pat. No. 5,617,889, which provides an umbrella being capable of opening or closing automatic. Before use, this umbrella is pressed first to compress springs in its shaft for storing energy. Then, to push a button on its handle, the umbrella is automatically opened. And to push the button second time, the umbrella will be closed automatically. This umbrella has still some leaks that it is usually out of work.

The present invention is to overcome the drawback of prior art and to provide an invented umbrella, which includes a totally new assembly and is different from any conventional umbrella, wherein a special character of the present invention is that the umbrella is prolonged before use. Now, accompanying with the following drawings, the character of the present invention will be described here and after.

DETAILED DESCRIPTION OF THE PREFERRED EMBODIMENT

Figure 1:
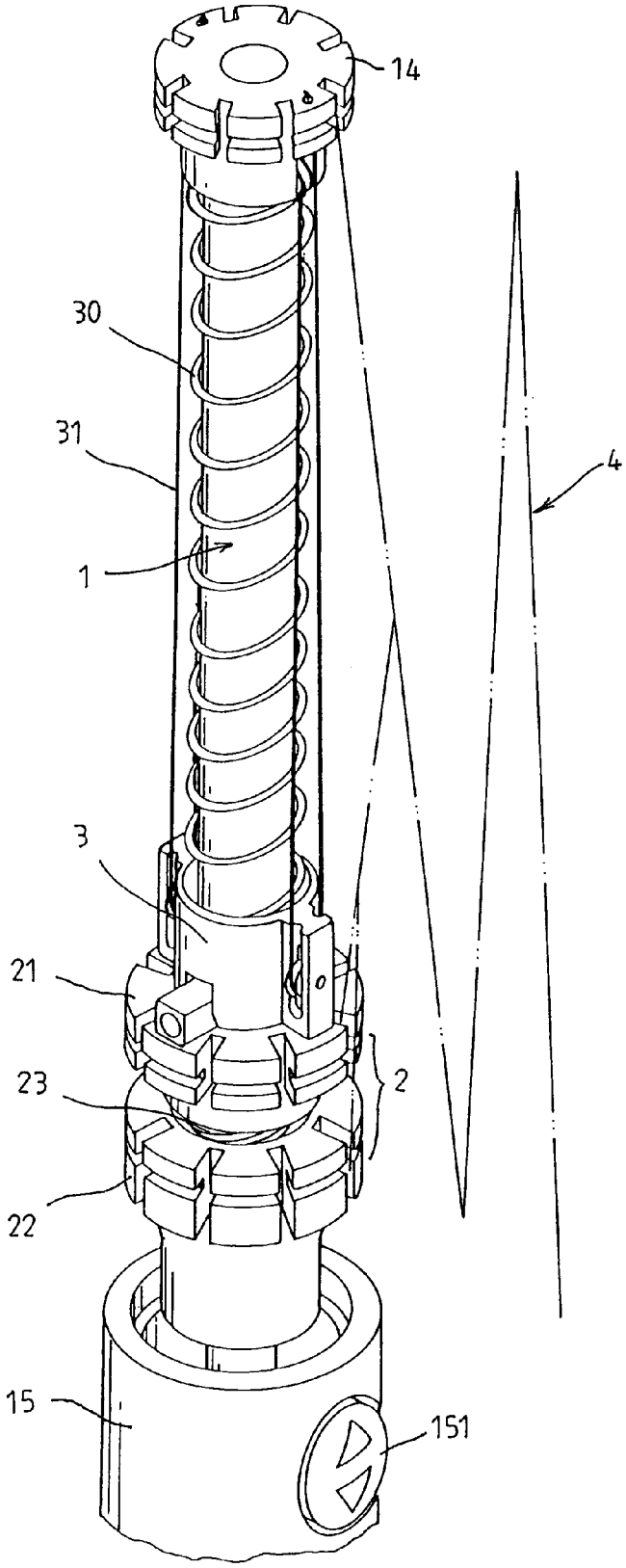
FIG. 1 is a perspective view showing a main portion of an automatic collapsible umbrella according to the present invention.

Referring to FIG. 1 to 5, the present invention relates to an improved collapsible umbrella, which can be opened or closed automatically, which includes a shaft (1) being consisted by several tubes. In this embodiment for explanation, the shaft (1) includes an outer tube (11), a middle tube (12), and an inner tube (13). A handle (15) with a button (151) is connected with lower end of the shaft (1) and an upper joint (14) is connected with top end of the shaft. A runner apparatus (2) provided around the shaft (1) included a middle runner (21) and a lower runner (22), wherein a control-open spring (23) is placed between both. A double-ear receiver (3) is provided around the shaft (1) above the runner apparatus (2). A control-close spring (30) is also provided around the shaft (1) between the upper joint (14) and the receiver (3). The umbrella frame (4) has its inner ends pivoted with the upper joint (14), middle runner (21), and the lower runner (22). By use of movement of the runners, the frame (4) is expended to open the umbrella or is concentrated to close the umbrella.

Figure 2:
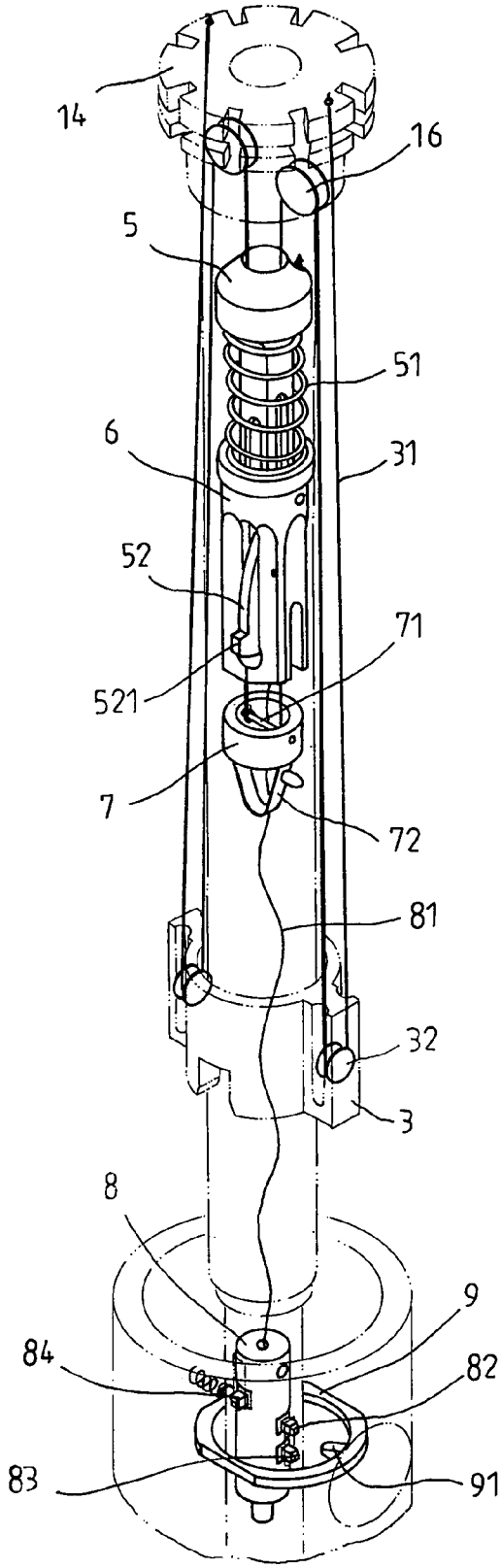
FIG. 2 is a perspective view showing the inner apparatus of FIG. 1.

As shown in FIG. 2, an upper controller (5) and a middle fixer (6) with an inner spring therebetween are provided in the shaft (1). A bow (52) received in the upper controller (5) has its lower hook end (521) extend outward from a slot (61) of the middle fixer (6). A lower fixer (7) placed below middle fixer (6) has a rod (71) for winding inner ends of two ropes (31), both of which have their out end extend upward to pass around a related wheel (16) under the upper joint (14), then downward to pass around another wheel (32) on the receiver (3), and at last upward to connect with the upper joint (14), meanwhile the ropes (31) are kept in tension always. The lower fixer (7) has a bottom V-shaped elastic slice (72). An inner controller (8) received in a lower inside position of the shaft (1) connects with lower end of an inner wire (81) having its upper end connect with the upper controller (5). The inner controller (8) is provided with an upper head (82) and a lower head (83) facing the button (151) of the handle (15) and a side projection (84) is formed on the controller (8). A loop (9) placed in the handle (15) has a convex (91) opposite to the button (151) and face the heads of the inner controller (8).

Figure 3:
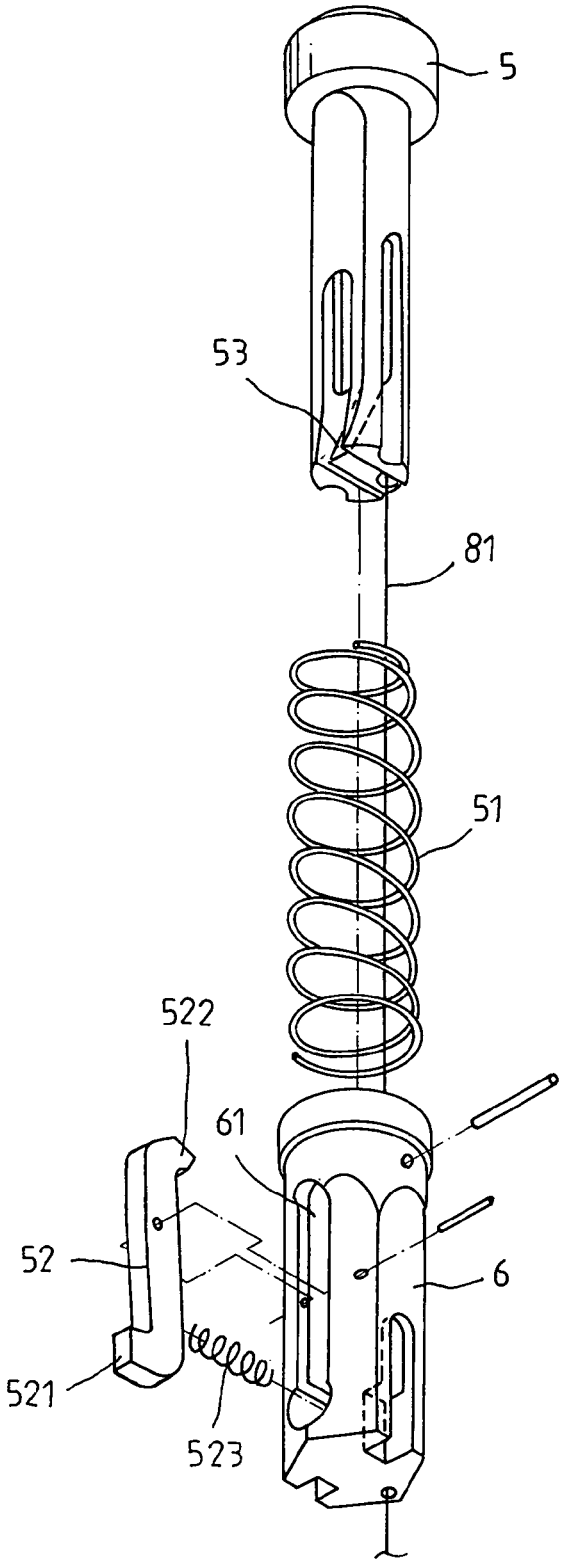
FIG. 3 is an exploded perspective view showing a portion of FIG. 2.

Please refer to FIG. 3, the upper controller (5) has its lower side an inclined plane (53) and the bow (52) has a top inner hook (522) and a lower hook end (521), wherein a small spring (523) is placed inside the lower hook end (521) to provide a stable elastic force for push the lower end outward.

Figure 4:
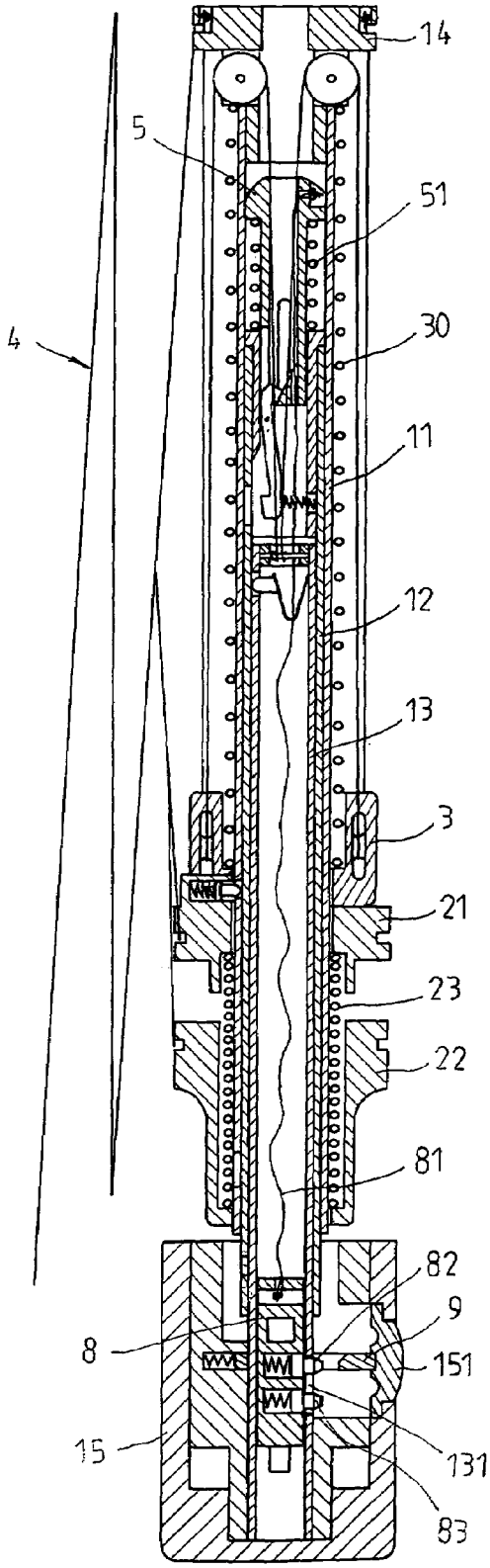
FIG. 4 is a cross-sectional plan view showing the umbrella being closed according to the present invention.
Figure 5:
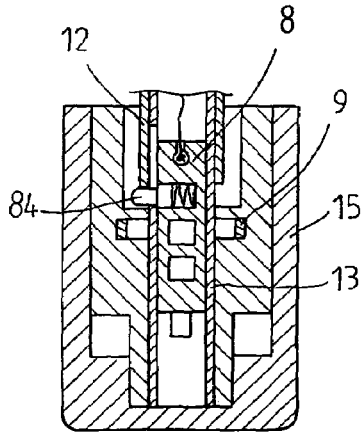
FIG. 5 is a cross-sectional plan view showing a handle of the automatic collapsible umbrella of FIG. 4 at a perpendicular plane.

As in FIG. 4 and 5, when the umbrella is in closed state, the upper head (82) is stopped in a slot (131) of the inner tube (13). The outer tube (11) has its bottom end contact with the side projection (84) of the inner controller (8). At this time, the control-close spring (30) and the inner spring (51) are prolonged, the control-open spring (23) is compressed, and the inner wire (81) is released. The frame (4) is closed beside the shaft (1) and the receiver (3) contacts with the middle runner (21) far away from the upper joint (14) that the umbrella is closed stably.

Figure 6:
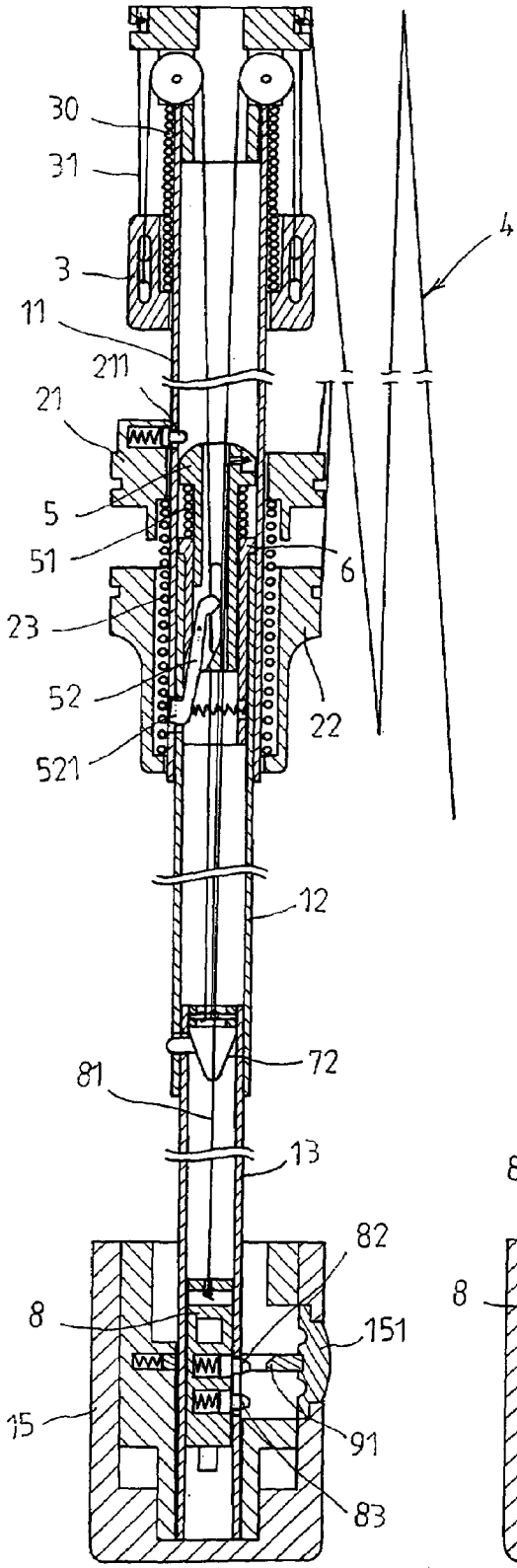
FIG. 6 is a cross-sectional plan view showing the umbrella shaft being prolonged relating to FIG. 4.
Figure 7:
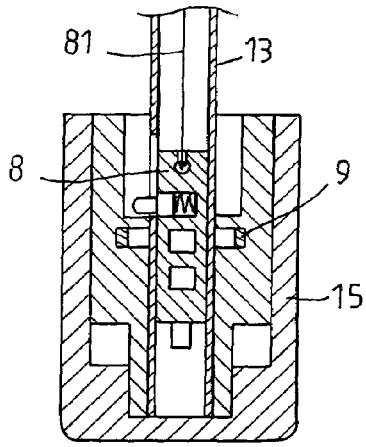
FIG. 7 is a cross-sectional plan view showing the umbrella handle of FIG. 6 at a perpendicular plane.

Before use, the umbrella is to be prolonged that the shaft (1) is extended as shown in FIG. 6 and 7. Since the upper controller (5) will be held by the inner wire (81) connected with the lower controller (8), it just moves a small distance till the inner wire (81) is in tension and will not move with the middle tube (12). At the moment, by use of the ropes (31), the receiver (3) is moved upward to compress the control-close spring (30). At the same time, the inner spring (51) is compressed because of the upward movement of the middle fixer (6). The lower hook end (521) of the bow (52) is then elastically pushed outward to engage with relating slots on the middle tube (12) and the outer tube (11) for positioning both. A high strength ball (211) provided on the middle runner (21) is engaged within a relating aperture of the outer tube (11) and the V-shaped elastic slice (72) is still engaged within relating apertures of the middle tube (12) and the inner tube (13). Hence, the tubes of the shaft (1) are stable for use.

Figures 8, 9:
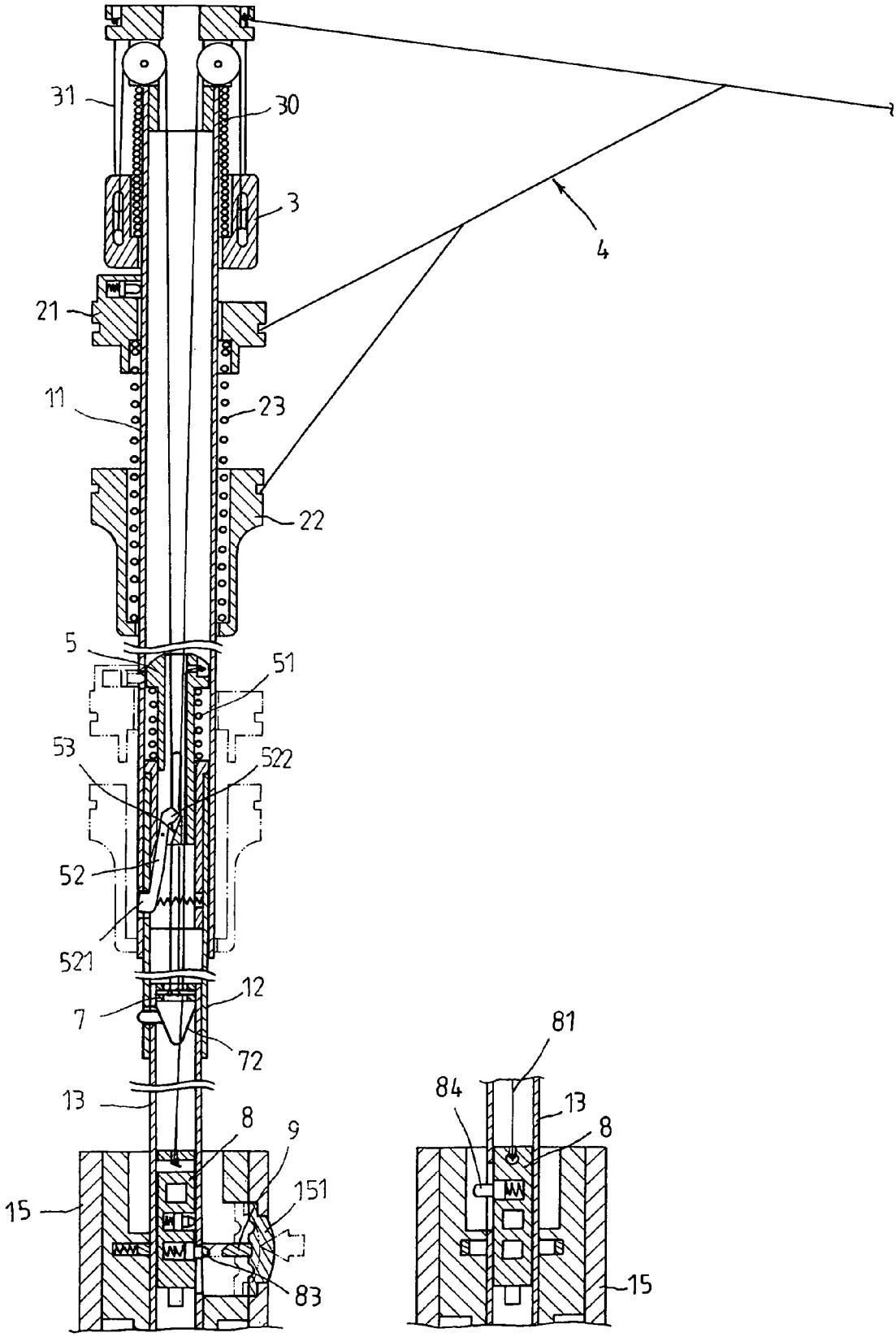
FIG. 8 is a cross-sectional plan view showing the umbrella being opened according to the present invention.
FIG. 9 is a cross-sectional plan view showing the umbrella handle of FIG. 8 at a perpendicular plane.

When a user pushes the button (151) first time, the loop (9) will be moved inward to have its convex (91) push the upper head (82) for releasing the engagement with the inner tube (13). Under recovery force of the inner spring (51), the upper controller (5) and the inner controller (8) are moved upward a small distance till the lower head (83) be stopped by the inner tube (13). At the time, the upper controller (5) has its top end push the ball (211) that the middle runner (21) will be released from the outer tube (11) due to the strong expensive elastic force of the control-open spring (23). As shown in FIG. 8 and 9, accompanying the said movement, the frame (4) will be expanded to open the umbrella automatically.

Figures 10, 11:
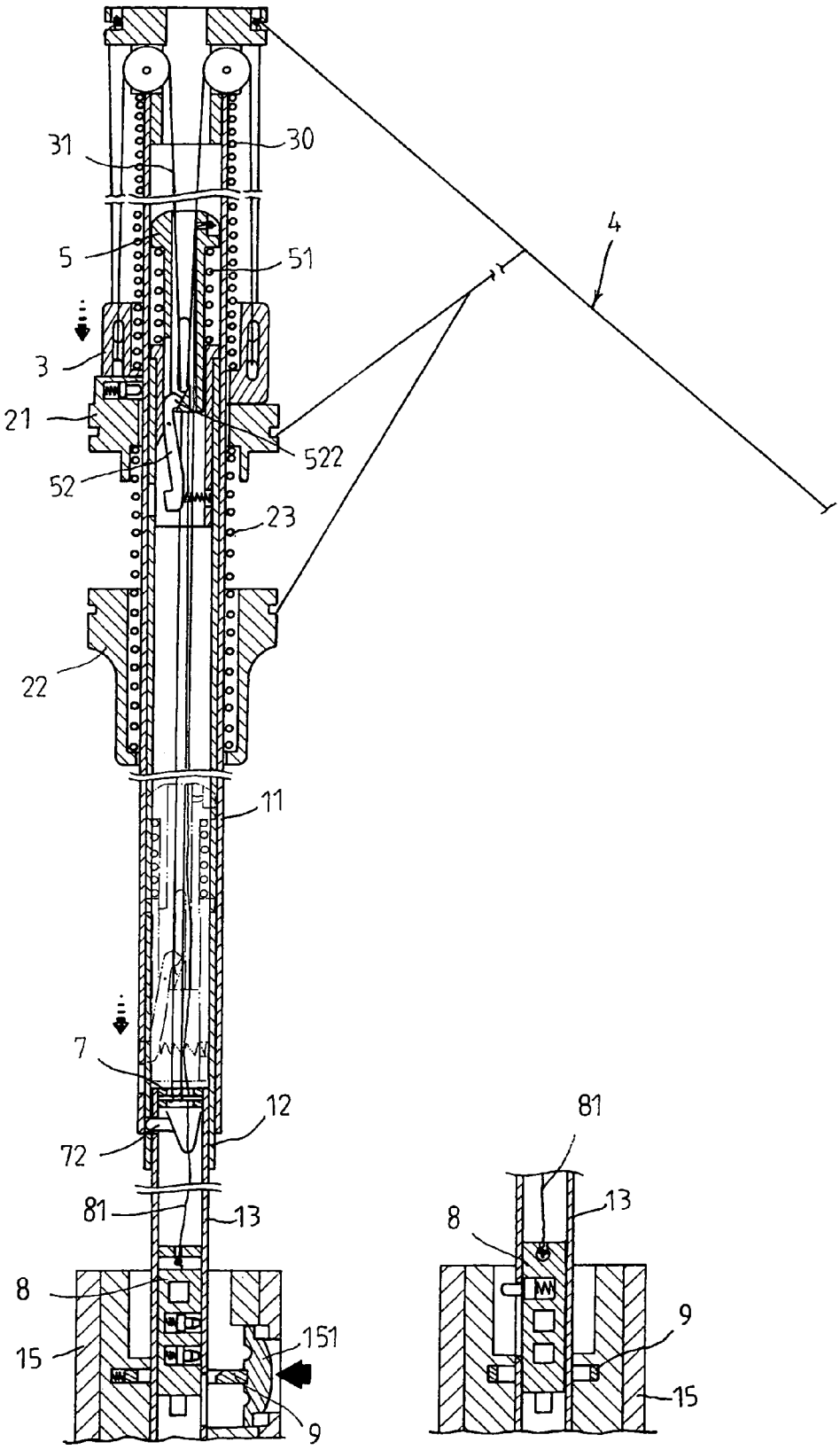
FIG. 10 is a cross-sectional plan view showing the umbrella being closing according to the present invention.
FIG. 11 is a cross-sectional plan view showing the umbrella handle of FIG. 10 at a perpendicular plane.

To close the umbrella, referring to FIG. 10 and 11, when the user pushes the button (151) second time, the lower head (83) will be pushed and released from the inner tube (13). Both controller (5) and (8) are capable of moving upward, meanwhile the lower inclined plane (53) will push the top inner hook (522) of the bow (52) to force the lower hook end (521) to move inward and release the engagement between the middle tube (12) and the outer tube (11). So, the middle tube (12) moves upward to be received in the outer tube (11) and then the outer tube (11) moves downward to press the V-shaped slice (72) to release the engagement between the middle tube (12) and the inner tube (13). At this time, the inner fixer (7) moves upward that the ropes (31) are not limited anymore. Therefore, the control-close spring (30) can rapidly extended to force the receiver (3) and the runner apparatus (2) downward that pulls the frame (4) concentrated to the shaft (1) and closes the umbrella automatically as in FIG. 4 and 5.

If a user wants to use the umbrella again, he just needs to repeat the above operation, i.e. to prolong the umbrella, a first touch to automatically open, and a second touch to automatically close. Thus, we can find that the operation of the present invention is totally different from the prior art and is useful for people to apply the umbrella as normal. Moreover, it can be understood that the above-mentioned embodiments including a frame with three folded ribs are only exemplary of the present invention. Any modification, such as a frame with four or more ribs and a shaft with four or more tubes, having the same or similar merit is still claimed in this application.

I claim:

1. An automatic collapsible umbrella comprised of:

a shaft consisting of at least three tubes, including an outer tube, a middle tube, and an inner tube;

a handle with a button, the handle being connected with a lower end of the shaft;

an upper joint being connected with a top end of the shaft;

a runner apparatus provided around the shaft including a middle runner and a lower runner, wherein a control-open spring is placed between the middle runner and the lower runner;

a double-ear receiver provided around the shaft above the runner apparatus, a control-close spring being provided around the shaft between the upper joint and the receiver;

a frame having its inner ends pivoted with the upper joint, the middle runner, and the lower runner such that by movement of the runners, the frame is expanded to open the umbrella or compressed to close the umbrella;

an upper controller and a middle fixer with an inner spring therebetween being provided in the shaft, a bow being received in the upper controller and having a lower hook end extending outward from a slot of the middle fixer, a lower fixer being placed below the middle fixer, the lower fixer having a rod for winding the inner ends of two ropes, both of which have their outer end extending upward to pass around a respective wheel under the upper joint, then downward to pass around a respective other wheel on the receiver, and finally upward to connect with the upper joint, the ropes being kept in tension, the lower fixer having a bottom V-shaped elastic slice, an inner controller being received in a lower inside position of the shaft and connecting with a lower end of an inner wire and having its upper end connected with the upper controller, the inner controller being provided with an upper head and a lower head facing the button of the handle and a side projection being formed on the controller; and a loop placed in the handle having a convex protrusion opposite to the button and facing the heads of the inner controller; the upper controller having on its lower side an inclined plane and the bow having a top inner hook and a lower hook end, wherein a small spring is placed inside the lower hook end to provide a stable elastic force for pushing the lower end outward;

wherein when the umbrella is placed into a closed state, the upper head is stopped in a slot of the inner tube, the outer tube having its bottom end in contact with the side projection of the inner controller, the control-close spring and the inner spring being uncompressed, the control-open spring being compressed, and the inner wire being released; thereby closing the frame around the shaft, the receiver making contact with the middle runner thereby stably closing the umbrella.

2. The automatic collapsible umbrella as claimed in claim 1, wherein responsive to the umbrella being opened without the shaft being fully extended, the upper controller being held by the inner wire connected with the lower controller, the upper controller being movable a small distance until the inner wire is in tension, the receiver being moved upward to compress the control-close spring, the inner spring being compressed responsive to the upward movement of the middle fixer, additionally the lower hook end of the bow being elastically pushed outwardly to engage with aligned slots on the middle tube and the outer tube to lock them in position, coincident therewith a high strength ball provided on the middle runner is received by an aperture in the outer tube while the V-shaped elastic slice remains disposed within the aligned slots of the middle tube and the inner tube.

3. The automatic collapsible umbrella as claimed in claim 2, wherein the loop being inwardly movable responsive to pushing the button to open the umbrella from a closed condition, the convex protrusion pushes the upper head to release the upper head from engagement with the inner tube, and the upper controller and the inner controller are moved upward a small distance by a recovery force of the inner spring until the lower head is stopped by the inner tube, the top end of the upper controller pushes the ball to thereby release the middle runner from the outer tube and, the frame being expanded to open the umbrella automatically responsive to a strong elastic force of the control-open spring.

4. The automatic collapsible umbrella as claimed in claim 3, wherein the lower head is released from the inner tube responsive to pushing the button to close the umbrella from an open condition, the lower inclined plane pushes the top inner hook of the bow to force the lower hook end to move inward and thereby release the middle tube and the outer tube, the middle tube moves upwardly to be received into the outer tube and the outer tube moves downwardly to press the V-shaped slice and thereby release the middle tube and the inner tube, responsive to the ropes no longer being in tension, the inner fixer moves upwardly and the control-close spring being rapidly uncompressed to force the receiver and the runner apparatus downwardly to bring the frame to the shaft and close the umbrella automatically.

5. The automatic collapsible umbrella as claimed in claim 1, wherein the frame of the umbrella includes four or more ribs and the shaft also includes four or more tubes.

* * * * *